US005725821A

United States Patent [19]

Gannon et al.

[11] Patent Number: 5,725,821

[45] Date of Patent: Mar. 10, 1998

[54] PROCESS FOR THE MANUFACTURE OF LYOCELL FIBRE

[75] Inventors: James Martin Gannon, Coventry; Ian Graveson, Nuneaton; Simon Ashley Mortimer, Coventry, all of United Kingdom

[73] Assignee: Courtaulds Fibres (Holdings) Limited, London, United Kingdom

[21] Appl. No.: 750,305

[22] PCT Filed: Jun. 19, 1995

[86] PCT No.: PCT/GB95/01440

§ 371 Date: Dec. 4, 1996

§ 102(e) Date: Dec. 4, 1996

[87] PCT Pub. No.: WO95/35400

PCT Pub. Date: Dec. 28, 1995

[30] Foreign Application Priority Data

Jun. 22, 1994 [GB] United Kingdom ..... 9412501

[51] Int. Cl.[6] ..... D01D 10/06; D01F 2/02

[52] U.S. Cl. ..... 264/203; 264/211.15; 264/233

[58] Field of Search ..... 264/187, 203, 264/207, 211.15, 233

[56] References Cited

U.S. PATENT DOCUMENTS

| | | | |
|---|---|---|---|
| 4,246,221 | 1/1981 | McCorsley, III | 264/203 |
| 5,403,530 | 4/1995 | Taylor | 264/187 |

FOREIGN PATENT DOCUMENTS

| | | |
|---|---|---|
| WO 92/14871 | 9/1992 | WIPO . |
| WO 95/14398 | 6/1995 | WIPO . |
| WO 95/35399 | 12/1995 | WIPO . |

OTHER PUBLICATIONS

Rudi Breier, "Die Verendlung Von Lyocellfasern–Ein Erfahrungsbericht", *Lenzinger Berichte, No. 9*: pp. 99–101 (Sep. 1994) [English Translation provided].

H. Firgo et al., "Kritische Fragen Zur Zukunft Der NMMO–Technolgie", *Lenzinger Berichte, No. 9*: pp. 81–89 (Sep. 1994) [English translation provided].

V.V. Romanov and O.B. Lunina, "Preparation of Hydrocellulose Fibres from Highly Concentrated Solutions of Cellulose in N–Methylmorphine–N–Oxide", *Fibre Chemistry*, vol. 25, No. 5, pp. 368–371 (1993).

*Primary Examiner*—Leo B. Tentoni
*Attorney, Agent, or Firm*—Howson & Howson

[57] ABSTRACT

A process of manufacturing lyocell fiber with an increased tendency to fibrillation which includes dissolving cellulose in a tertiary amine N-oxide solvent to form a solution. The degree of polymerization of the cellulose is not more than about 450 and the concentration of cellulose in the solution is at least 16 percent by weight. The solution is extruded through a die to form a plurality of filaments which are washed to remove the solvent, thereby forming the lyocell fiber which is then dried.

5 Claims, No Drawings

PROCESS FOR THE MANUFACTURE OF LYOCELL FIBRE

FIELD OF THE INVENTION

This invention relates to a process for manufacturing lyocell fibre with an increased tendency to fibrillation.

It is known that cellulose fibre can be made by extrusion of a solution of cellulose in a suitable solvent into a coagulating bath. This process is referred to as "solvent-spinning", and the cellulose fibre produced thereby is referred to as "solvent-spun" cellulose fibre or as lyocell fibre. Lyocell fibre is to be distinguished from cellulose fibre made by other known processes, which rely on the formation of a soluble chemical derivative of cellulose and its subsequent decomposition to regenerate the cellulose, for example the viscose process. One example of a solvent-spinning process is described in U.S. Pat. No. 4,246,221, the contents of which are incorporated herein by way of reference. Cellulose is dissolved in a solvent such as an aqueous tertiary amine N-oxide, for example N-methylmorpholine N-oxide, generally containing a small proportion of water. The resulting solution is then extruded through a suitable die into an aqueous bath by way of an air gap to produce an assembly of filaments which is washed with water to remove the solvent and is subsequently dried. Lyocell fibres are known for their impressive textile-physical properties, such as tenacity, in comparison with fibres such as viscose rayon fibres.

Fibre may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Such fibrillation is believed to be caused by mechanical abrasion of the fibre during treatment in a wet and swollen state. Higher temperatures and longer times of treatment generally tend to produce greater degrees of fibrillation. Lyocell fibre appears to be particularly sensitive to such abrasion and is consequently often found to be more susceptible to fibrillation than other types of cellulose fibre. Intensive efforts have been made to reduce the fibrillation of lyocell fibres.

The presence of fibrillated fibres is advantageous in certain end-uses. For example, filter materials containing fibrillated fibres generally have high efficiency. Fibrillation is induced in paper-making processes by beating the fibres, which is generally known to increase the strength and transparency of the paper. Fibrillation may also be utilised in the manufacture of non-woven fabrics, for example hydroentangled fabrics, to provide improved cohesion, cover and strength. Although the fibrillation tendency of lyocell fibres is higher than that of other cellulose fibres, it is not always as great as may be desired for some end-uses. It is an object of the present invention to provide lyocell fibre with an increased fibrillation tendency.

BACKGROUND ART

In a paper in Fibre Chemistry, Vol.25 (1993), No.5, pages 368–371, V. V. Romanov and O. B. Lunina describe solutions of cellulose in N-methylmorpholine-N-oxide containing 10 to 30 percent by weight cellulose. The degree of polymerisation (D.P.) of the cellulose was 600. The solutions were extruded through an air gap into an aqueous coagulation bath to form lyocell fibres. Flow instability in the air gap was observed with solutions containing more than 15 percent cellulose.

DISCLOSURE OF INVENTION

The present invention provides a process for the manufacture of lyocell fibre with an increased tendency to fibrillation, including the steps of (1) dissolving cellulose in a tertiary amine N-oxide solvent to form a solution, (2) extruding the solution through a die to form a plurality of filaments, (3) washing the filaments to remove the solvent, thereby forming lyocell fibre, and (4) drying the lyocell fibre, characterised in that the degree of polymerisation of the cellulose is not more than about 450 and the concentration of cellulose in the solution is at least 16 per cent by weight.

The solvent preferably comprises N-methylmorpholine N-oxide (NMMO), and it generally additionally comprises a small proportion of water. The filaments are generally washed in step (3) with an aqueous liquor to remove the solvent from the filaments.

The degree of polymerisation (D.P.) of cellulose is conveniently assessed by viscosimetry of a dilute solution of cellulose in a solvent which is an aqueous solution of a metal/amine complex, for example cuprammonium hydroxide solution. A suitable method, based on TAPPI Standard T206, is described hereinafter as Test Method 1. Cellulose D.P. is a measure of the number of anhydroglucose units per molecule. It will be understood that D.P. measured in this manner is a viscosity-average D.P.

Reducing the D.P. of the cellulose used in the manufacture of lyocell fibres generally corresponds to a reduction in fibre tenacity. This would normally be thought to be most undesirable. It has nevertheless been found that fibre manufactured by the process of the invention has satisfactory tensile properties for use in the end-uses in which fibrillation is desirable, for example the manufacture of paper and non-woven articles.

The D.P. of cellulose used in the manufacture of known lyocell fibre is commonly in the range 400 to 700, the concentration of cellulose in the solution used to make such fibre being no more than about 15 percent by weight. The D.P. of cellulose used in the manufacture of lyocell fibre according to the method of the invention may be not more than about 400, preferably not more than about 350, further preferably not more than about 300. The D.P. of the cellulose is preferably at least about 200, because it has generally been observed that it is difficult to extrude solutions containing cellulose with significantly lower D.P. than this value so as to form satisfactory filaments. The D.P. of the cellulose is further preferably at least about 250.

It will be appreciated that the D.P. of cellulose may fall during its processing from native fibre to lyocell fibre in a solvent-spinning process as a result of cellulose degradation on handling, the fall often being in the range from 40–80 D.P. units. It will further be appreciated that the extent of such degradation is generally less in large production units operated continuously. Except as otherwise specified, the cellulose D.P. referred to herein is that of the cellulose introduced into the dissolution step (1).

It has surprisingly been found that the fibrillation tendency of lyocell fibre is directly related to the cellulose concentration of the solution from which it is made. The concentration of cellulose in the solution is preferably as high as possible having regard to the need to maintain the viscosity of the solution below the practical maximum working viscosity. It will be understood that higher cellulose concentrations can be used if cellulose of low D.P. is used, because solution viscosity is directly related both to concentration and to D.P. The concentration of cellulose in the solution used in the process of the invention is preferably at least 17 per cent by weight, more preferably at least 18 per cent by weight, further preferably at least 19 or 20 per cent by weight. The concentration of cellulose in the solution is preferably no more than about 28 per cent by weight, further preferably no more than about 26 per cent by weight. It has been found that such solutions can readily be extruded to form filaments by conventional air-gap spinning techniques.

The preferred relationship between cellulose D.P. and concentration in the solution used in the method of the invention is indicated in general terms in Table A below:

TABLE A

| | Cellulose concentration, wt % | |
|---|---|---|
| Cellulose D.P. | Min. | Max. |
| 450 | about 16 | about 20 |
| 400 | about 16 | about 21 |
| 300 | about 18 | about 25 |
| 250 | about 19 | about 26 |
| 200 | about 22 | about 28 |

The preferred relationship may alternatively be defined whereby the value of the expression $$\ln(\text{D.P.})\times\ln(\text{cellulose concentration, weight \%})$$

where ln represents the natural logarithm, is preferably in the range 16.95 to 18.3.

Lyocell fibre is generally produced in the form of tow which is commonly converted into short length staple fibre for further processing, either in the never-dried state or the dried state. Lyocell fibre manufactured by the process of the invention may be unpigmented (bright or ecru) or pigmented, for example incorporating a matt pigment such as titanium dioxide.

The fibrillation tendency of lyocell fibre manufactured by the process of the invention may be further increased by subjecting it after the washing and/or drying steps to conditions which reduce the D.P. of the cellulose, for example severe bleaching treatments.

Lyocell fibre produced by the process of the invention is useful, for example in the manufacture of paper and nonwoven articles, either alone or in blends with other types of fibre, including standard lyocell fibre. A papermaking slurry containing lyocell fibre made by the process of the invention requires markedly less mechanical work, for example beating, refining, disintegration or hydrapulping, to reach a chosen degree of freeness than a slurry containing standard lyocell fibre. Lyocell fibre made by the process of the invention may fibrillate in low-shear devices such as hydrapulpers, which induce little or no fibrillation in conventional fibres under usual operating conditions. Lyocell fibre made by the process of the invention may have enhanced absorbency and wicking properties compared with conventional lyocell fibre, making it useful in the manufacture of absorbent articles.

Paper made from lyocell fibre manufactured according to the invention may be found to have a variety of advantageous properties. It has generally been found that the opacity of paper containing lyocell fibre increases as the degree of beating is increased. This is opposite to the general experience with paper made from woodpulp. The paper may have high air-permeability compared with paper made from 100% woodpulp; this is believed to be a consequence of the generally round cross-section of the lyocell fibres and fibrils. The paper may have good particle-retention when used as a filter. Blends of lyocell fibre made by the process of the invention and woodpulp provide papers with increased opacity, tear strength and air permeability compared with 100% woodpulp papers. Relatively long, for example 6 mm long, lyocell fibre may be used in papermaking compared with conventional woodpulp fibres, yielding paper with good tear strength.

Examples of applications for paper containing lyocell fibre manufactured according to the invention include, but are not limited to, capacitor papers, battery separators, stencil papers, papers for filtration including gas, air and smoke filtration and the filtration of liquids such as milk, coffee and other beverages, fuel, oil and blood plasma, security papers, photographic papers, flushable papers and food casing papers, special printing papers and teabags.

It is an advantage of the invention that hydroentangled fabrics can be made from lyocell fibre manufactured according to the invention at lower entanglement pressures than are required for standard lyocell fibre for similar fabric properties, at least for short staple lengths (up to about 5 or 10 mm). This reduces the cost of hydroentanglement. Alternatively, a greater degree of hydroentanglement can be obtained at a given pressure than with prior art lyocell fibre. A hydroentangled fabric made from lyocell fibre manufactured according to the invention may have better tensile properties than a fabric made from standard lyocell fibre, although it will be understood that hydroentangling conditions will need to be optimised by trial and error for the best results in any particular case. A hydroentangled fabric containing lyocell fibre manufactured according to the invention may exhibit high opacity, high particle retention in filtration applications, increased barrier and wetting properties, high opacity, and good properties as a wipe.

Examples of applications for hydroentangled fabrics containing lyocell fibre manufactured according to the invention include, but are not limited to, artificial leather and suede, disposible wipes (including wet, lint-free, clean-room and spectacle wipes), gauzes including medical gauzes, apparel fabrics, filter fabrics, diskette liners, coverstock, fluid distribution layers or absorbent covers in absorbent pads, for example diapers, incontinence pads and dressings, surgical and medical barrier fabrics, battery separators, substrates for coated fabrics and interlinings.

Lyocell fibre made by the process of the invention may fibrillate to some extent during dry processes for nonwoven fabric manufacture, for example needlepunching. Such nonwoven fabrics may exhibit improved filtration efficiency in comparison with fabrics containing conventional lyocell fibre.

The fibre made by the process of the invention is useful in the manufacture of textile articles such as woven or knitted articles, alone or in combination with other types of fibre, including prior art lyocell fibre. The presence of the lyocell fibre made by the process of the invention may be used to provide desirable aesthetic effects such as a peachskin effect. Fibrillation can be induced in such fabrics by known processes such as brushing and sueding in addition to any fibrillation generated in the wet processing steps normally encountered in fabric manufacture.

Fibre manufactured according to the process of the invention is useful in the manufacture of teabags, coffee filters and suchlike articles. The fibre may be blended with other fibres in the manufacture of paper and hydroentangled fabrics. The fibre may be blended as a binder with microglass fibre to improve the strength of glass fibre paper made therefrom.

The fibre may be felted in blend with wool. The fibre may be used in the manufacture of filter boards for the filtration of liquids such as fruit and vegetable juices, wine and beer. The fibre may be used in the manufacture of filter boards for the filtration of viscous liquids, for example viscose. The fibre may be made into tampons and other absorbent articles with improved absorbency. Lyocell fibre may fibrillate advantageously during dry as well as during wet processing, for example during processes such as milling, grinding, sueding, brushing and sanding. Fibrils may be removed from fibrillated lyocell fibre by enzyme finishing techniques, for example treatment with cellulases.

The following procedures identified as Test Methods 1 to 3 may be employed to assess cellulose D.P. and fibrillation tendency.

TEST METHOD 1

Measurement of Cuprammonium Solution Viscosity and D.P. (the D.P. Test)

This test is based on TAPPI Standard T206 os-63. Cellulose is dissolved in cuprammonium hydroxide solution containing 15±0.1 g/l copper and 200±5 g/l ammonia, with nitrous acid content <0.5 g/l, (Shirley Institute standard) to give a solution of accurately-known cellulose concentration (about 1% by weight). Solution flow time through a Shirley viscometer at 20° C. is measured, from which viscosity may be calculated in standard manner. Viscosity average D.P. is determined using the empirical equation:

$$D.P.=412.4285\ ln[100(t-k/t)/n.C]-348$$

where t is flow time in seconds, k the gravity constant, C the tube constant, and n the density of water in g/ml at the temperature of the test (0.9982 at 20° C.).

TEST METHOD 2

Measurement of Fibrillation Tendency (Sonication)

Ten lyocell fibres (20±1 mm long) are placed in distilled water (10 ml) contained within a glass phial (50 mm long × 25 mm diameter). An ultrasonic probe is inserted into the phial, taking care that the tip of the probe is well-centered and is positioned 5±0.5 mm from the bottom of the phial. This distance is critical for reproducibility. The phial is surrounded with an ice bath, and the ultrasonic probe is switched on. After a set time, the probe is switched off, and the fibres are transferred to two drops of water placed on a microscope slide. A photomicrograph is taken under ×20 magnification of a representative area of the sample. Fibrillation Index (Cf) is assessed by comparison with a set of photographic standards graded from 0 (no fibrillation) to 30 (high fibrillation).

Alternatively, Cf may be measured from the photomicrograph using the following formula:

$$Cf=n.x/L$$

where n is the number of fibrils counted, x is the average length of the fibrils in mm, and L is the length in mm of fibre along which fibrils are counted.

The ultrasonic power level and sonication time (5–15 minutes, standard 8 minutes) required may vary. The calibration of the equipment should be checked using a sample of fibre of known fibrillation tendency (Cf 4–5 by Test Method 2) before use and between every group of five samples.

TEST METHOD 3

Measurement of Fibrillation Tendency (The Disintegration Test)

Lyocell fibre (6 g, staple length 5 mm) and demineralised water (2 l) are placed in the bowl of the standard disintegrator described in TAPPI Standard T-205 om-88, and disintegrated (simulating valley beating) until the fibre is well-dispersed. Suitable disintegrators are available from Messmer Instruments Limited, Gravesend, Kent, UK and from Büchel van de Korput BV, Veemendaal, Netherlands. The Canadian Standard Freeness (CSF) of the fibre in the resulting slurry or stock is measured according to TAPPI Standard T227 om-94 and recorded in ml. In general, the stock is divided into two 1 l portions for measurement of CSF and the two results averaged. Curves of CSF against disintegrator revolutions or disintegration time may then be prepared and the relative degree of disintegration required to reach a given CSF assessed by interpolation. The zero point is defined as that recorded after 2500 disintegrator revolutions, which serve to ensure dispersion of the fibre in the stock before CSF measurement.

Test Method 2 is quick to perform, but may give variable results because of the small fibre sample. Test Method 3 gives very reproducible results. These factors should be taken into account during assessment of fibrillation tendency.

The invention is illustrated by the following Example, in which parts and proportions are by weight unless otherwise specified:

EXAMPLE

Lyocell fibre was spun from solutions of woodpulp cellulose of varying D.P. (measured by Test Method 1) at various concentrations in aqueous N-methylmorpholine N-oxide and assessed for fibrillation tendency by Test Method 2. The D.P. of cellulose in the fibre was also measured by Test Method 1. The results shown in Table 1 were obtained:

TABLE 1

| Ref. | Woodpulp D.P. | Fibre D.P. | Concentration % | Fibrillation Index |
|---|---|---|---|---|
| | | SAICCOR woodpulp | | |
| S1 | 250 | 143 | 18.4 | 4.8 |
| S2 | 304 | 183 | 18.4 | 3.8 |
| S3 | 400 | 247 | 16.4 | 4.2 |
| S4 | 400 | — | 17.3 | 3.6 |
| S5 | 400 | 252 | 18.8 | 6.3 |
| S6 | 505 | 362 | 16.2 | 1.8 |
| S7 | 505 | 359 | 17.4 | 2.9 |
| S8 | 590 | 436 | 15.4 | 1.5 |
| S9 | 590 | 427 | 16.3 | 2.3 |
| | | Viscokraft woodpulp | | |
| V1 | 415 | 369 | 16.9 | 2.5 |
| V2 | 415 | 369 | 19.1 | 3.8 |
| V3 | 415 | 378 | 21.0 | 5.5 |
| V4 | 433 | — | 15.6 | 2.5 |
| V5 | 433 | — | 17.5 | 2.7 |
| V6 | 433 | — | 19.9 | 3.4 |
| V7 | 500 | — | 17.1 | 1.5 |
| V8 | 600 | — | 15.3 | 0.9 |

A dash in the Table indicates that no measurement was made. Samples S6–S9, V4 and V7–V8 were comparative examples, not according to the invention. It will be observed that, at any particular D.P., Fibrillation Index rose as the concentration of cellulose in the solution was increased. SAICCOR is a Trade Mark of Sappi Saiccor (Pty.) Ltd., South Africa. Viscokraft is a Trade Mark of International Paper Co., USA. The low D.P. samples of SAICCOR woodpulp were produced by electron-beam irradiation. The low D.P. samples of Viscokraft woodpulp were produced by bleaching.

We claim:

1. A process for the manufacture of lyocell fibre with an increased tendency to fibrillation, comprising the steps of:

(1) dissolving cellulose in a tertiary amine N-oxide solvent to form a solution, (2) extruding the solution through a die to form a plurality of filaments, (3) washing the filaments to remove the solvent, thereby forming lyocell fibre, and (4) drying the lyocell fibre, wherein the degree of polymerisation of the cellulose is not more than about 450 and the concentration of cellulose in the solution is at least 16 percent by weight.

2. A process according to claim 1, wherein the degree of polymerisation of the cellulose is in the range from about 200 to about 450.

3. A process according to claim 2, wherein the degree of polymerisation of the cellulose is in the range from about 250 to about 350.

4. A process according to claim 1, wherein the concentration of cellulose in the solution is in the range from 16 to 28 percent by weight.

5. A process according to claim 1, wherein the value of the expression: ln(degree of polymerisation) × ln(weight percent concentration of cellulose), is in the range from 16.95 to 18.3.

* * * * *